United States Patent [19]

Yamauchi et al.

[11] Patent Number: 4,754,802

[45] Date of Patent: Jul. 5, 1988

[54] CONTINUOUS CASTING APPARATUS FOR STEEL PLATE

[75] Inventors: Takashi Yamauchi; Morihiro Hasegawa; Takayuki Nakanori, all of Yamaguchi, Japan

[73] Assignee: Nisshin Steel Co., Ltd., Tokyo, Japan

[21] Appl. No.: 81,736

[22] Filed: Aug. 5, 1987

[51] Int. Cl.[4] ..... B22D 11/06

[52] U.S. Cl. ..... 164/428; 164/480

[58] Field of Search ..... 164/428, 480, 481, 431, 164/432

[56] References Cited

FOREIGN PATENT DOCUMENTS 60-15051 1/1985 Japan ..... 164/428

60-21157 2/1985 Japan ..... 164/428

*Primary Examiner*—Kuang Y. Lin

*Attorney, Agent, or Firm*—Wenderoth, Lind & Ponack

[57] ABSTRACT

In a twin roll system continuous casting machine for continuously casting a steel plate through a gap between a pair of internal cooling rolls rotating in the opposite direction to each other, a continuous casting apparatus for steel plate comprises side dams installed on both sides of the pair of rolls to form a pouring basin on the circumferential surfaces of the pair of rolls, the side dams consisting of fixed side dams contacting molten steel in the pouring basin and movable side dams installed below the fixed side dams and substantially without contacting the molten steel in the pouring basin and moving in the same direction as the cast plate.

5 Claims, 5 Drawing Sheets

CONTINUOUS CASTING APPARATUS FOR STEEL PLATE

This invention relates to improvements on a twin roll system continuous casting machine for continuously casting steel plates directly from molten steel.

It is well known a so-called twin roll system continuous casting machine in which a pair of internal cooling rolls having respectively horizontal axes and rotating in the opposite direction to each other are disposed parallel to each other by leaving a proper gap therebetween, a pouring basin is formed on the circumferential surfaces of rolls (the upper halves of cylindrical surfaces in the axial directions of rolls) above the gap and molten metal in the pouring basin is continuously cast into a metal plate through the gap while cooling the molten metal by the circumferential surfaces of rotating rolls. There has also had such a proposal that the twin roll system continuous casting machine noted above is applied to a case of continuous casting of steel to produce the steel plate directly from the molten steel.

When a steel plate product is continuously cast through the gap between a pair of rolls at all times, it is necessary to form a pouring basin for molten steel on the circumferential surfaces above the gap of the pair of rolls, thereby continuously pouring the molten steel into the pouring basin so as to maintain the level of molten steel substantially constant. In order to form the pouring basin, a pair of dams are always required. The pair of dams regulate the outflow of molten steel along the roll axes on the circumferential surfaces of rolls and have their surfaces perpendicular to the roll axes, respectively. These dams serve usually to regulate the width of cast steel plate. In this specification, these dams are referred as "side dams". In addition to these side dams, a pair of front and rear gates having their surfaces along the roll axes may be erected orthogonally to the side dams on the circumferential surfaces of the pair of rolls to form a box-like pouring basin with the side dams and the front and rear gates. However, when the pair of rolls have sufficient large radii, respectively, the front and rear gates along the roll axes are not always needed. In this case, the circumferential surfaces themselves of the pair of rolls may fulfill respective parts of the front and rear gates.

Heretofore, fixed side dams having plate-like bodies of refractories secured to both sides of the pair of rolls have been applied to the side dams which have been proposed the most generally. When the fixed side dams are installed on both sides of the pair of rolls, following two systems are well known. One is a system of erecting the side dams on the circumferential surfaces of the pair of rolls such that the bottoms of the side dams slidably contact the circumferential surfaces of the pair of rolls respectively and the other is a system of installing the side dams on the outsides of the pair of rolls such that respective parts of the side dam inner surfaces slidably contact both sides of rolls perpendicular to the roll axes (in this specification, both sides of rolls are referred as roll side surfaces).

In lieu of the fixed side dam, a movable side dam using an endless metal belt or caterpillar is well known. For example, Japanese Patent Publication Laid-open No. 188548/83 has disclosed a system in which the side dams pressed against both roll side surfaces are shaped to be flat blocks which are interlocked with endless belts, thereby rotating said endless belts in the casting direction. The block is a kind of caterpillar. The molten steel existing on the circumferential surfaces of the pair rolls and tending to flow axially of the rolls is dammed up by the movable blocks and simultaneously both edges of steel plate to be cast through the roll gap downward are also held by these blocks while moving downward.

Japanese Patent Publication Laid-open No. 205658/83 has disclosed a caterpillar system in which caterpillar moulds are urged against both roll side surfaces as the side dams, similarly to a system disclosed by the Japanese Patent Publication Laid-open No. 188548/83 noted above. In this case, the movable moulds also dam up the molten steel existing on the circumferential surfaces of the pair of rolls and tending to flow axially of the rolls and simultaneously both edges of the steel plate to be cast move downward while being held by these molds.

Japanese Patent Publication Laid-open No. 234744/85 has disclosed a system in which grooves extending vertically on the insides of the fixed side dams are formed on the side dam inner surfaces at central portions thereof and then endless belts or caterpillars are moved in these grooves downwardly from a top. Accordingly, the molten steel on the circumferential surfaces is dammed up by both of endless belts or caterpillars and the side dam surfaces on both sides of the grooves. Thereby, both edges of the cast steel plate emerging from the roll gap will move downward synchronously while being held by the belts or caterpillars.

When the molten steel plate is continuously cast by means of the fixed side dams and movable side dams which are known per se, the following problems are encountered.

First, when the fixed side dams are used, friction is generated between the fixed side dams and the edges of cast steel plate moving while expanding widthwise in the proximity of the narrowest gap (roll gap) of the pair of rolls. Namely, two thin solidified shells are formed on the surfaces of both internal cooling rolls and butted against each other at a position somewhat above the roll gap. Then the soldified shells thus united to each other at the roll gap are depressed. When the shell receives the depression thereon, it will expand widthwise in the axial direction of the roll. However, when the fixed side dam surface exists in the portion having the widthwise expansion, the edges of steel plate to be cast moving downward with the widthwise expansion will move while pressing the inner surface of the fixed side dam thereagainst. Thus, the inner surface of the fixed side dam is scraped off and deformed due to wear. The molten steel is liable to leak from the deformed portion due to the variation of casting conditions or the side dam will develop into the situation of breakage. Also, in view of the cast plate side, since the smooth movement of cast plate is restrained due to this friction, the edges of cast plate may cause cracks so that satisfactory cast plate will be difficult to stationarily produce.

In order to avoid these problems, the lower ends of the fixed side dams are located above a solidification completing position (where the solidified shells grown on the circumferential surfaces of both rolls are butted against each other) such that the fixed side dams are absent below the solidification completing position. However, in this case, such trouble may occur that the molten steel existing above the solidification completing position flows out of said position to the outside when the solidification completing position is lowered due to the variation of casting conditions. Particularly, in an the narrowest gap of the pair of rolls (namely, the thickness of steel plate to be cast), since the solidification completing position is vertically moved due to the variation of the width of the gap of the pair of rolls, it is extremely important to solve the problem noted above.

On the other hand, when the movable side dams such as endless metal belts, caterpillars or the like which are known per se are used the problem of friction between the solidified shells and the side dams may be substantially overcome by moving said movable side dams in synchronization with the transfer speed of the cast steel plate. However, the following new problem is encountered. This is because when the molten steel is dammed up by the movable side dams, it is difficult to effect heating or heat preservation of the inner surfaces of the movable side dams at a temperature higher than the solidifying point temperature of molten steel. In this case, the side dams at a low temperature will contact sequentially the molten steel in the pouring basin. Therefore, the molten steel in the pouring basin is cooled on the surfaces of the movable side dams. Further, generally segmental side shells flaring upward in the direction orthogonal to the solidified shells formed on the surfaces of the rolls are liable to grow along the inner surfaces of the movable side dams. The side shells thus formed are crushed up by the rolls when said shells pass through the roll gap. Even satisfactory solidified shells formed on the circumferential surfaces of the rolls are broken along with the breakage of the side shells due to the crush. At this time, sheet cracks and inoperative situations are liable to result. Further, a gap is generated between the movable side dams and the roll side surfaces due to the crushing pressure of the side shells so that the molten steel may be caused to leak and casting fins formed in the gap may restrain the movement of the steel plate to be cast.

An object of the present invention is to provide a twin roll system continuous casting machine which can overcome said problems encountered when fixed side dams and movable side dams, which have been hitherto proposed, are used in the twin roll system continuous casting machine and which can stably and directly produce satisfactory steel plates from molten steel.

According to the present invention, in the twin roll system continuous casting machine in which a pair of internal cooling rolls rotating in the opposite direction to each other are disposed paralleld to each other and side dams are disposed on both sides of the pair of rolls to form a pouring basin on the circumferential surfaces of said rolls, thereby continuously casting the molten steel in the pouring basin into a steel plate through a gap between the pair of rolls, a continuous steel plate casting apparatus is characterized in that both side dams include fixed side dams formed of plate-like bodies having the lower edges located above the narrowest position between the pair of rolls and contacting and damming up the molten steel in the pouring basin and movable side dams taking charge of positions below said lower edges of the fixed side dams, said movable side dam being formed of an endless member installed rotatably in the casting direction.

In the apparatus according to the present invention, the side dams are divided into the fixed side dams and movable side dams. The fixed side dams serve to dam up the outflow of molten steel in the direction of roll axis from the pouring basin formed on the cirucmferential surfaces of the pair of rolls. The inner surfaces of the fixed side dams, which will contact the molten steel, are constituted from refractories. The fixed side dams, however, do not extend to a portion where both solidified shells formed on the surfaces of both internal cooling rolls abut against each other while being depressed (rolled) by the roll gap to expand widthwise in the direction of the roll axis. Namely, the lower edges of the fixed side dams are placed at positions at least above the narrowest gap of the pair of rolls, more particularly, at positions equal with or slightly higher than the solidification completing position of the solidified shells (where both solidified shells formed on the surfaces of both internal cooling rolls abut against each other). The movable side dams are placed adjacent to the lower portions of lower edges of the fixed side dams such that the gap between the movable side dams and said lower edges of the fixed side dams is not substantially formed. That is, the movable side dams are installed at the lower positions where there is few possibility of contacting the bulk of molten steel in the pouring basin so as to include at least the level of the narrowest gap of the pair of rolls in the plane of the movable side dam. Thus, the movable side dams are installed to sandwich both side edges (both edges of steel plate to be cast) of the solidified shells which receive the depression in the roll gap to expand widthwise in the direction of the roll axis upon being depressed in the roll gap. Also, the movable side dams are movable in synchronization with the speed (corresponding to the rotational speed of rolls) of steel plate passing through said roll gap. The movable side dams are constituted from endless belts or caterpillars. When using the endless belt, the belt itself is constituted from a metal plate to provide the movable side dam itself. When using the caterpillar, a plurality of flat refractories or metal plates (caterpillar) are connectively mounted to an endless chain to be trained over sprockets for providing an endless caterpillar type of side dam.

In the apparatus according to the present invention, the fixed side dams made of refractores are preferably erected on the circumferential surfaces of the pair of rolls with the lowest central edges being located above the narrowest gap so that the bottom planes with the exception of the lowest central edges of said dams slidably contact the circumferential surfaces of the pair of rolls on both sides of rolls. When the fixed side dam erected on the circumferential surface is fixed at the position, the outer surface of the fixed side dam is preferably connected to the inner surface of a back-up plate fixed in position.

Also, a guide member for the movable side dam is preferably disposed below the back-up plate to permit the belt or caterpillar to pass along the inside of the guide member. To the guide member is preferably given elastic pressure directed from the outside to the inside. Further, when using the belt, a small-diameter roll is preferably mounted on the upper and lower portions of the guide member in order to attenuate the friction between the guide member and the belt.

Hereinafter will be described a preferred embodiment of the twin roll system continuous casting machine according to the present invention with reference to drawings.

Figure 4:
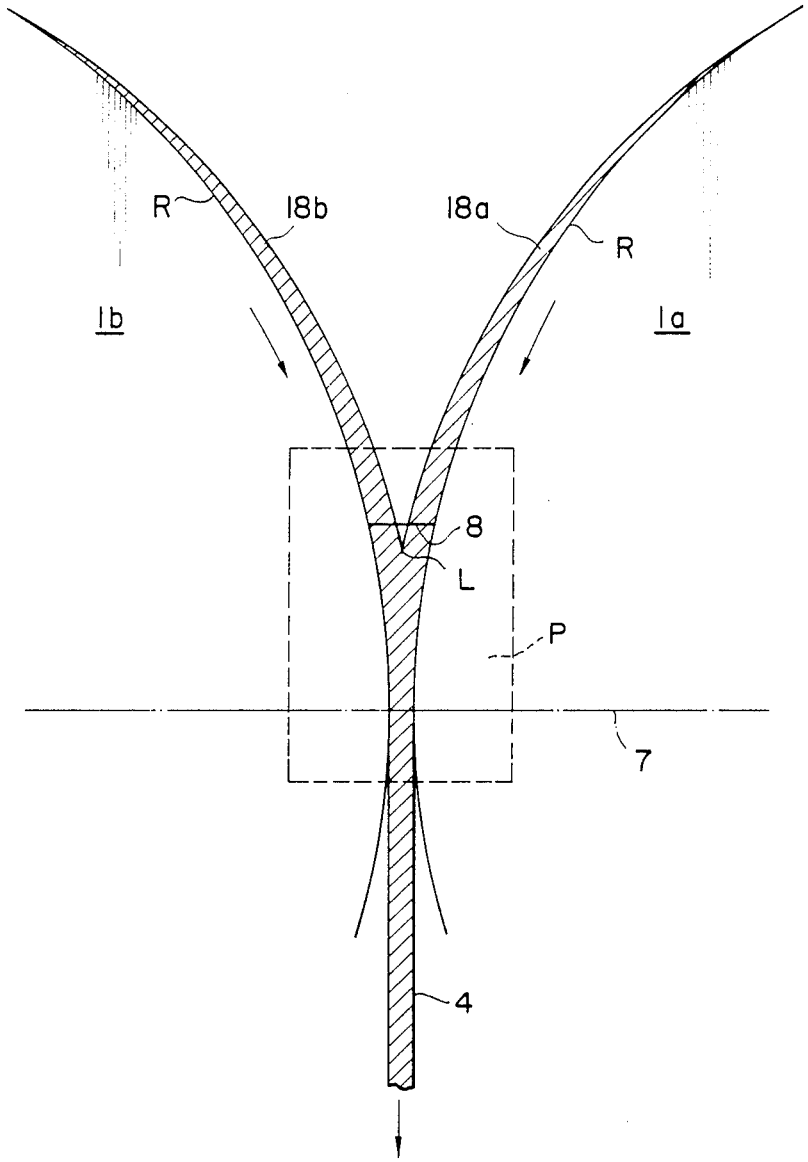
Figure 5:
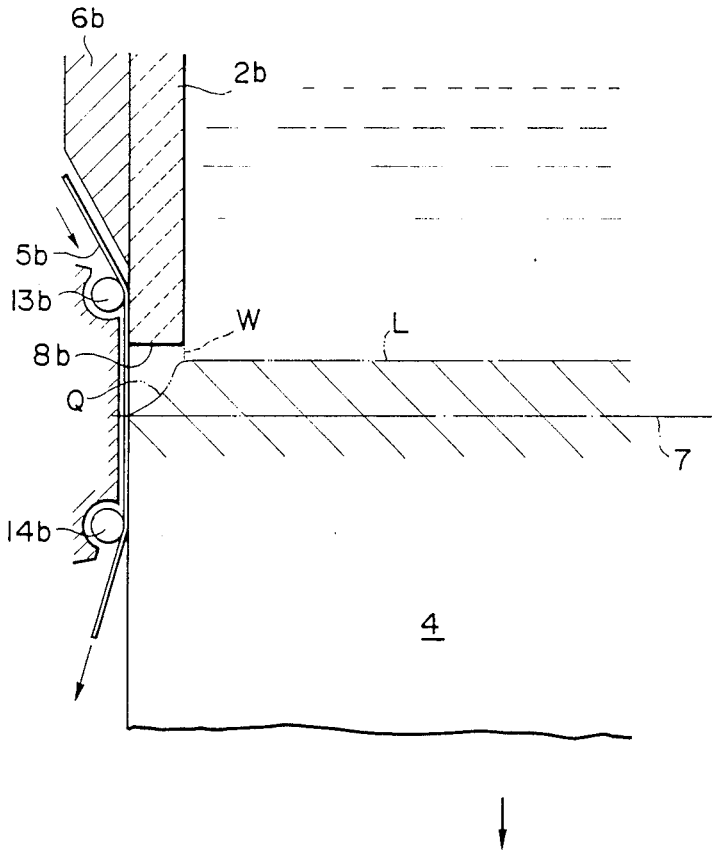

FIG. 4 is a schematic sectional view taken perpendicularly to the roll axis and showing solidified shells formed on the surfaces of internal cooling rolls during the operation of the apparatus according to the present invention and pressed against each other in a gap between a pair of rolls, the positions of lower edge of a fixed side dam and movable side dam being schematically shown; and FIG. 5 is a schematic sectional view of one side dam taken along the central vertical plane of the pair of rolls (vertical plane along the roll axis) and showing the condition of an edge of cast steel plate formed during the operation of the apparatus according to the present invention.

Figure 1:
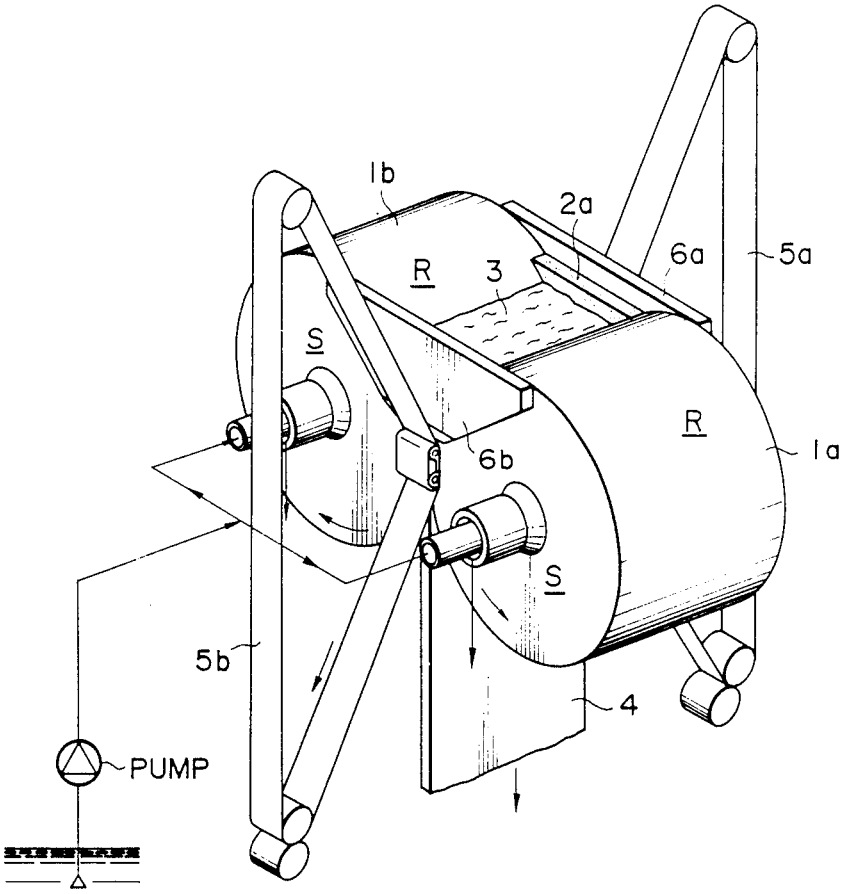
FIG. 1 is a perspective view showing principal portions of an embodiment of the apparatus according to the present invention.

As shown in FIG. 1, a preferred embodiment of the apparatus according to the present invention is as follows. A pair of internal cooling rolls 1a,1b rotating in the opposite direction to each other are disposed parallel to each other with their roll axes held horizontally. In a twin roll system continuous casting machine for continuously casting molten steel in a pouring basin formed on the circumferential surfaces R of the pair of rolls 1a,1b into a steel plate 4 through a gap between the pair of rolls 1a,1b, fixed side dams 2a,2b made of refractories are erected on the circumferential surfaces R of both sides of the pair of rolls 1a,1b such that the bottoms of said fixed side dams slidably contact the circumferential surfaces R (one fixed side dam 2b is concealed and not seen in FIG. 1) to thereby form a pouring basin 3 in a space above the pair of rolls. Movable side dams using endless metal belts 5a,5b are provided adjacent to the lower portions of both fixed side dams 2a,2b. Reference numeral 4 designates a still plate to be cast. The molten steel is poured continuously into the pouring basin 3 to cast into a continuous steel plate through the gap between the pair of rotating rolls 1a,1b vertically downward. Reference numerals 6a,6b designate back-up plates for fixing the side dams 2a,2b from respective outsides.

In the apparatus shown in FIG. 1, the pair of rolls 1a,1b consist of internal cooling rolls rotating in the opposite direction to each other (each rotational direction of both rolls is shown by arrow). According to the embodiment shown in the drawing, water cooling rolls are used as the pair of rolls respectively. More particularly, the pair of rolls 1a,1b are formed on the insides of drums constituting the circumferential surfaces R with coiled cooling water paths (not shown). Water is passed through said paths to cool the cirucmferential surfaces R at a predetermined temperature. Cooling water is supplied to and drained from the cooling water paths on the insides of the circumferential surfaces R through the roll shafts. Thus, the roll shaft is of a double pipe construction. An inner pipe serves as a cooling water supply pipe and an annular pipe path which is formed between outer and inner pipes serves as a drain pipe. In the interior of the roll, the cooling water supply pipe which is the inner pipe is connected to a cooling water path inlet which is provided inside the circumferential surface R. The annular pipe path is connected to a cooling water outlet. When cooling water is continuously supplied from a pump to the inner pipe according to the constitution as shown in the drawing, the supplied cooling water is circulated through the cooling water path located inside the circumferential surface R and then drained through the annular pipe path. This operation of passing the cooling water may be continuously carried out during the operation of the apparatus.

Figure 2:
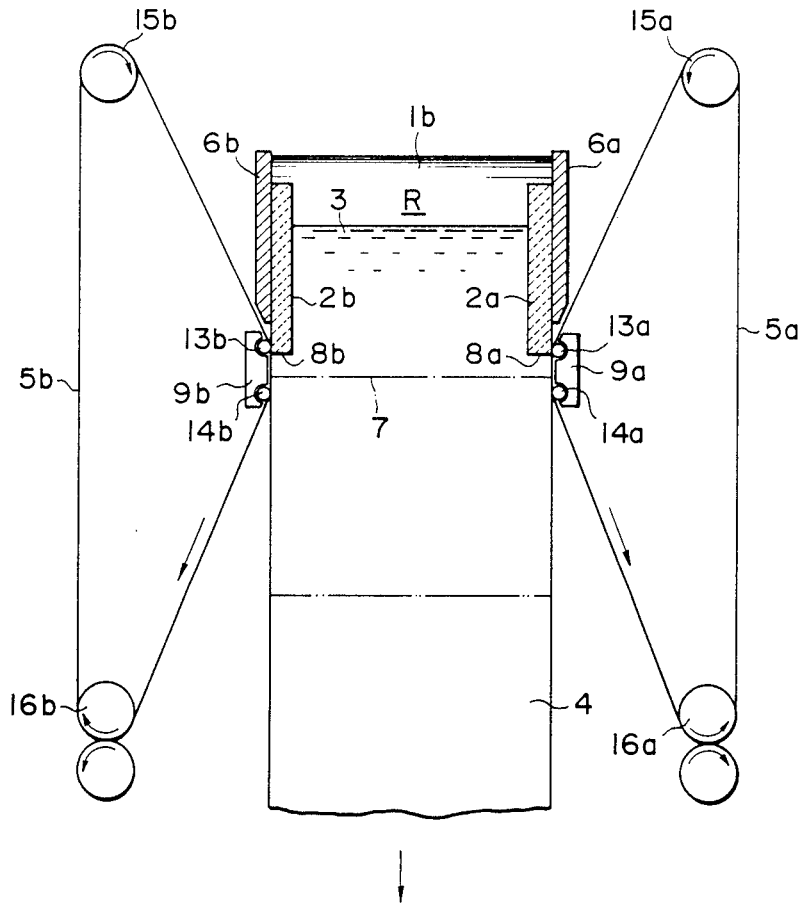
FIG. 2 is a schematic sectional view of the apparatus shown in FIG. 1 taken along the central vertical plane (vertical plane along the roll axis) of a pair of rolls.
Figure 3:
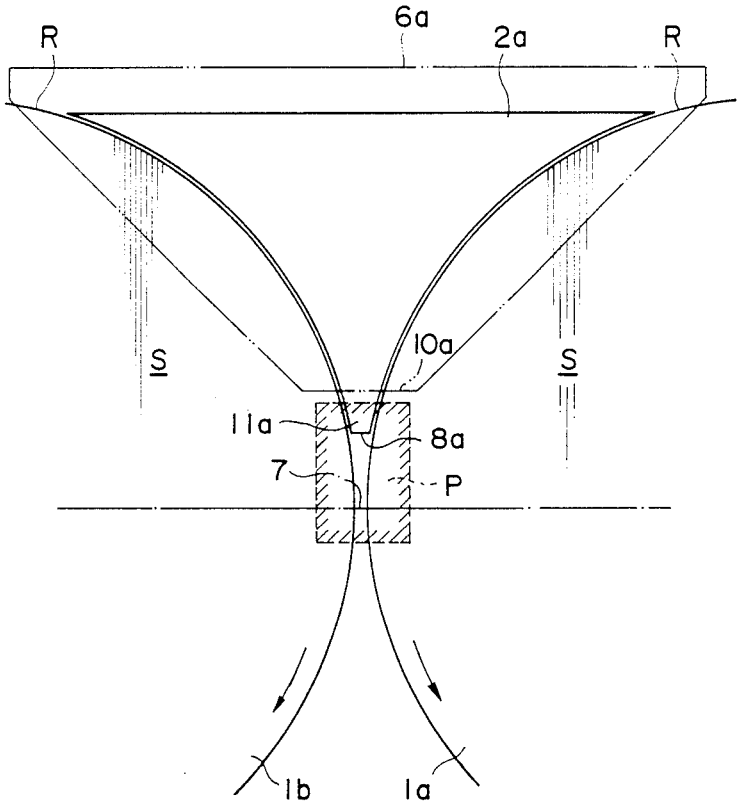
FIG. 3 is a schematic view for explaining a position pressed by a movable side dam.

FIG. 2 is a sectional view of the apparatus shown in FIG. 1, taken along the plane of the steel plate 4 being cast. Reference numeral 7 shown in FIG. 2 designates a portion (plane including both center lines of the pair of rolls 1a,1b) corresponding to the narrowest gap between said rolls. As shown in FIG. 2, the fixed side dams 2a,2b made of refractories and installed according to the present invention have their lower edges 8a,8b located above the narrowest gap portion 7 between the pair of rolls 1a,1b. This relationship is also shown in FIG. 3. The fixed side dams 2a,2b are erected on the circumferential surfaces R on both extreme side ends of the pair of rolls 1a,1b such that the most parts of respective fixed side dam bottoms (except for the lower edges 8a,8b) slidably contact said surfaces R. Namely, the fixed side dams 2a,2b have respectively curved surfaces corresponding to the circumferential surfaces R of the pair of rolls 1a,1b on both lower sides. A position where said curved surfaces join each other at the central lower portion is set to the lowermost end which provides the lower edge 8a or 8b. As shown in FIG. 3, the lower edges 8a,8b cross horizontally and linearly the gap between the pair of rolls 1a,1b. The linear lower edges 8a,8b do not slidably contact the circumferentail surfaces R of the pair of rolls 1a,1b.

Further, the fixed side dams 2a,2b to be erected are positioned such that the outside wall surfaces (vertical surfaces) thereof are substantially coplanar with the side surfaces S (FIG. 1) of the pair of rolls 1a,1b. That is, only the thickness portions of the fixed side dams 2a,2b made of plate-like refractores enter inward from the side surfaces S, respectively. This positioning is carried out by connecting the inner surfaces of the back-up plates 6a,6b having their positions fixed by fixing means (not shown) with the outer surfaces of the fixed side dams 2a,2b which are flush with the side surfaces S, respectively. The back-up plates 6a,6b consist of, for example, metal plates having areas protruding both sides from the fixed side dams 2a,2b. The inner surfaces of protruded side portions slidably contact the side surfaces S of the pair of rolls 1a,1b. Also, the lowermost ends of the back-up plates 6a,6b are located somewhat above the lower edges 8a,8b of the fixed side dams 2a,2b. While, in the embodiment shown, the fixed side dams 2a,2b and back-up plates 6a,6b are constituted from separate members connected to each other, both members may be formed in one body made of refractories. The lower edges 8a,8b of the fixed side dams 2a,2b are preferably located above a position where the molten steel is completely solidified under the stationary condition during the operation of casting, which will be later described.

The endless metal belts 5a,5b of the movable side dams are pressed against the roll side surfaces S by belt guide members 9a,9b respectively such that said belts 5a,5b substantially contact the side surfaces S of the rolls near the narrowest gap 7 between the pair of rolls 1a,1b, more particularly, a space in the narrowest gap portion 7 below the lower edges 8a,8b of the fixed side dams 2a,2b is sealed from the roll side surfaces S. The portions pressed by these belt guide members 9a,9b are shown diagrammatically in FIG. 3. Referring to FIG. 3, an area P surrounded by the broken lines represents the area of the endless metal belts 5 pressed by the belt guide members 9a,9b. While FIG. 3 shows the area P of a portion pressed by the belt guide member 9a at one side in FIG. 2, the area of a portion pressed by the belt guide member 9b at the opposite side is quite same. In the embodiment shown, the lower edge 8a of the fixed side dam 2a extends lower than the lower end 10a of the back-up plate 6a. Further, the outer surface of a portion 11a (exposed end) extending downward is positioned on the substantially same vertical plane as the roll side surface S. The portion P, against which the flat endless metal belt 5a is pressed, has an area including both the exposed end 11a of the fixed side dam 2a and roll side surfaces S in the same vertical surface as said exposed end. More particularly, this portion P has a square area, the upper side of the portion P exists above the lower edge 8a of the fixed side dam 2a on the outer surface side of said dam 2a and below the lower end 10a of the back-up plate 6a. Also, the lower side thereof exists below the nallowest gap portion 7 or on the same level as said portion 7. The width of the portion P corresponds to that of the belt which can cover sufficiently a generally segmental space formed between the lower edge 8a of the fixed side dam 2a and the narrowest gap portion.

As shown in FIG. 2, the belt guide members 9a,9b are provided vertically with small-diameter idle rolls 13a,13b and 14a,14b in order to facilitate the movement of the endless metal belts 5a,5b. While the endless metal belts 5a,5b are moved in synchronization with the casting speed of rolls 1a,1b and that of steel plate to be cast, the belts 5a,5b are continuously driven by motors (not shown) through upper and lower rollers 15a,15b and 16a,16b in the direction of arrows shown in FIG. 2. The number of the roller and loop configuration of the belt are not specially limited. The moving speed of the belt is preferably synchronized with the peripheral speed of the roll, but it is not necessary to accurately synchronize the belt moving speed with the roll peripheral speed. Also, in order to improve a lubricating property or facilitate the disengagement of the belt from the edge surface of steel plate, a mold releasing agent of oil type, molybdenum sulfide type, oxide type, nitride type or the like may be applied to the surfaces of the endless metal belts 5a,5b or ceramic coating may be applied to said surface, for example. If necessary, the endless metal belts 5a,5b may be forcibly cooled. While the belt guide members 9a,9b are positioned at predetermined positions, these members are given elasticity at the time of positioning. That is, the whole belt guide members 9a,9b are adapted to elastically move back and forth with some allowance, the elastic force being given by a spring material (not shown).

FIGS. 4 and 5 illustrate the solidifying state of the steel plate when it is continuously cast from the molten steel by the apparatus according to the present invention and also show the parts of the fixed side dams and movable side dams. In both drawings, members designated by the same reference numerals as those in FIGS. 1 to 3 correspond to those described with reference to FIGS. 1 to 3. During the casting operation of the apparatus according to the present invention, thin solidified shells 18a,18b as shown in FIG. 4 are formed on both circumferential surfaces R of the pair of rolls 1a,1b. Both solidifed shells 18a,18b are developed while moving arcuately as the pair of rolls 1a,1b are rotated, and eventually overlapped with each other in the roll gap. The position where both shells are overlapped is designated by reference symbol L in the drawing. This position L is referred as the solidification completing position. The molten steel is still present above the solidification completing position L and substatially absent below said position L. Since the overlapping solidified shells receive depression (rolling) in the roll gap below the solidification completing position L, the total thickness of the shells is reduced while lateral expansion of the shells is generated in the lateral direction (widthwise of the steel plate to be cast). This lateral expansion is shown at a portion Q in FIG. 5. The side dam of the apparatus according to the present invention is fundamentally characterized in that the movable side dams take charge of a positional portion in which the lateral expansion of the solidified shell is generated and the fixed side dams take charge of portion in which the lateral expansion of the solidified shell above the solidification completing position L is not generated. Thus, in the most preferred embodiment of the apparatus according to the present invention, the fixed side dams 2a,2b are disposed such that the lower edges 8a,8b of the fixed side dams 2a,2b exist slightly above the solidification completing positon L. Further the movable side dams take charge of the lower portions of the lower edges 8a,8b. In this case, the solidification completing position L will exist in the area in which the movable side dams take charge of. When the movable side dam is moved at the substantially same speed as the plate to be cast as mentioned above, the inner surface of the movable side dam and laterally expanded edge of the cast plate are moved downward synchronously under the condition that they are closely attached to each other. Therefore, friction between the closely attached surfaces may be avoided. Also, the side dams according to the present invention are characterized remarkably in that the molten steel in the pouring basin is dammed up by the fixed side dams and the movable side dams do not take charge of the damming-up of the molten steel. Accordingly, since the movable side dams seldom contact the molten steel, it is possible to avoid such fact that the molten steel is solidified directly on the inner surfaces of the movable side dams to develop the solidified shells on said inner surfaces. While some molten steel may overflow from a position designated by reference symbol W in FIG. 5 (position between the lower edge 8b of the fixed side dsam and the solidification completing position L) toward the movable side dam, the overflow amount of molten steel is extremely small, which is negligible, compared with the amount of molten steel in the pouring basin. Even if the small amount of molten steel would flow out of the pouring basin, it is immediately cooled on the surfaces of the movable side dams which are paid off successively. The cooled molten steel may form a portion of the edge of cast plate. Therefore, troubles in operation may be avoided. To avoid completely such troubles, preferably the movable side dams are forcibly cooled. The movable side dams may be cooled simply by cooling the belt guide member according to the embodiment shown in the drawing.

In the embodiment noted above are described the movable side dams using the endless metal belts 5a,5b. Even if the movable side dams according to the present invention are of a caterpillar type in which a plurality of flat plates are attached to the endless chain, they can fulfill the substantially same function as the embodiment noted above. Further, the fixed side dams 2a,2b are preferably heated before casting and further preferably during casting. The fixed side dams 2a,2b may be heated by inserting a heater generating heat due to current supply into refractories constituting said fixed side dams.

The present inventors produced an apparatus shown in FIG. 1 to thereby cast continuously steel plates from the molten steel. The pair of rolls 1*a*,1*b* were constituted from a pair of internal cooling rolls having the circumferential surfaces R made of S40C steel member, the diameter of 400 mm and the width of 300 mm. The narrowest gap between the pair of rolls 1*a*,1*b* was set to 3 mm and the fixed side dams 2*a*,2*b* made of silica were set on the circumferential surfaces of said rolls at both ends such that the lower edges 8*a*,8*b* are located higher than the narrowest position by 40 mm. The fixed side dams 2*a*,2*b* were supported at predetermined positions by the back-up plates 6*a*,6*b* made of steel. The endless steel belts 5*a*,5*b* having the thickness of 2 mm and the width of 30 mm were pressed against the roll side surfaces S such as to maintain the relationship with the position P described in FIG. 3 and set to prevent the molten steel from leakage. Molten stainless steel of SUS304 was supplied into the pouring basin to set the height of the molten steel level from the narrowest gap portion to 174 mm. The moving speed of the endless steel belts 5*a*,5*b* was synchronized with the casting speed of 40 m/min to carry out casting. Before the casting, the fixed side dams 2*a*,2*b* were preheated. As a result, stable casting could be performed without any troubles. Further, the steel plate having the satisfactory shape of widthwise edge thereof was obtained without any defects such as cracks in the edge.

What is claimed is:

1. In a twin roll system continuous casting machine including a pair of internal cooling rolls rotating in the opposite direction to each other and opposed parallel to each other with their axes being held substantially horizontal and side dams disposed on both sides of the pair of rolls and damming up the outflow of molten steel in the direction of the roll axes, whereby a pouring basin is formed on the circumferential surfaces of the pair of rolls and the molten steel in the pouring basin is continuously cast into a steel plate through a gap between the pair of rolls, a continuous casting apparatus for steel plate comprising:

fixed side dams consisting of plate-like bodies having the lower edges located above the narrowest position of the pair of rolls and contacting the molten steel in the pouring basin to dam up said molten steel;

movable side dams taking charge of positions below said lower edges of the fixed side dams;

said fixed and movable side dams being constituted said both side dams; and said movable side dams consisting of endless members installed rotatably in the casting direction.

2. A continuous casting apparatus for steel plate according to claim 1, wherein the lower edges of the fixed side dams are located somewhat above positions where both thin solidified shells formed on the circumferential surfaces of the pair of rolls during the operation of the apparatus overlap with each other (solidification completing position) and the movable side dams installed below said fixed side dams cover the ranges including the solidification completing position.

3. A continuous casting apparatus for steel plate according to claim 1, wherein said endless members are formed of endless metal belts.

4. A continuous casting apparatus for steel plate according to claim 1, wherein said movable side dams are installed substantially without contacting the bulk of molten steel in the pouring basin.

5. A continuous casting apparatus for steel plate according to claim 2, wherein both fixed side dams are formed of plate-like bodies made of refractories and having a predetermined thickness, the outer surfaces of the plate-like bodies being flush with the side surfaces of the pair of rolls so that the thickness portions are erected on the circumferential surfaces of the pair of rolls and located in positions by back-up plates connected to the outsides of the plate-like bodies and said endless members of the movable side dams are pressed along the side surfaces of the pair of rolls by belt guide members, the vertical range, in which the endless member is pressed, existing from a position higher than the lower edge of the outer surface of the plate-like body of said fixed side dam to a position lower than the narrowest gap portion of the pair of rolls.

* * * * *